US007224155B2

(12) United States Patent
Bo et al.

(10) Patent No.: US 7,224,155 B2
(45) **Date of Patent: *May 29, 2007**

(54) METHOD AND APPARATUS FOR CURRENT LIMITATION IN VOLTAGE REGULATORS

(75) Inventors: Gian Marco Bo, Savona (IT); Massimo Mazzucco, Savona (IT)

(73) Assignee: Atmel Corporation, San Jose, CA (US)

( * ) Notice: Subject to any disclaimer, the term of this patent is extended or adjusted under 35 U.S.C. 154(b) by 260 days.

This patent is subject to a terminal disclaimer.

(21) Appl. No.: 10/888,790

(22) Filed: Jul. 9, 2004

(65) Prior Publication Data

US 2005/0035749 A1 Feb. 17, 2005

(30) Foreign Application Priority Data

Jul. 10, 2003 (IT) ..... TO2003A0533

(51) Int. Cl.
*G05F 3/16* (2006.01)

(52) U.S. Cl. ..... 323/312; 323/315

(58) Field of Classification Search ..... 323/312, 323/313, 314, 315, 316, 280
See application file for complete search history.

(56) References Cited

U.S. PATENT DOCUMENTS

| | | | | |
|---|---|---|---|---|
| 4,593,338 | A | 6/1986 | Takeda et al. | 361/18 |
| 4,605,891 | A | 8/1986 | Wrathall | 323/313 |
| 4,771,228 | A * | 9/1988 | Hester et al. | 323/315 |
| 4,851,953 | A | 7/1989 | O Neill et al. | 361/101 |
| 5,570,060 | A | 10/1996 | Edwards | 327/541 |
| 5,614,850 | A | 3/1997 | Corsi et al. | 327/55 |
| 5,789,971 | A | 8/1998 | Colletti et al. | 327/541 |
| 5,955,915 | A | 9/1999 | Edwards | 327/541 |
| 6,304,108 | B1 | 10/2001 | Inn | 327/72 |
| 6,396,311 | B2 | 5/2002 | Inn | 327/70 |
| 6,407,537 | B2 | 6/2002 | Antheunis | 323/312 |
| RE37,778 | E | 7/2002 | Feldtkeller | 323/277 |
| 6,476,667 | B1 | 11/2002 | Teggatz et al. | 327/538 |
| 6,480,043 | B2 | 11/2002 | Hall et al. | 327/108 |
| 6,522,111 | B2 * | 2/2003 | Zadeh et al. | 323/277 |
| 6,580,257 | B2 | 6/2003 | Marty | 323/280 |
| 6,801,419 | B2 | 10/2004 | Fukui | 361/93.1 |
| 6,804,102 | B2 | 10/2004 | Hamon et al. | 361/93.3 |
| 6,861,832 | B2 * | 3/2005 | Perez | 323/316 |
| 7,005,924 | B2 * | 2/2006 | Can et al. | 330/298 |
| 2002/0005738 | A1 | 1/2002 | Inn | 327/51 |
| 2004/0051508 | A1 | 3/2004 | Hamon et al. | 323/280 |

* cited by examiner

*Primary Examiner*—Adolf Berhane
(74) *Attorney, Agent, or Firm*—Sierra Patent Group, Ltd.

(57) ABSTRACT

A circuit for limiting a power current from a power-controlling pass device, the power-controlling pass device being coupled to a supply voltage, comprises the following. A sense device is coupled to the supply voltage with the sense device being configured to draw a sense current that is proportional to the power current. A current mirror is coupled to the sense device and the supply voltage through a low impedance node, the current mirror being configured to draw a mirror current through the low impedance node that is relative to the sense current. A limiting device is coupled to the supply voltage, the power-controlling pass device, and the low impedance node, the limiting device being configured to limit the power current according to a voltage difference between the low impedance node and the supply voltage.

31 Claims, 4 Drawing Sheets

METHOD AND APPARATUS FOR CURRENT LIMITATION IN VOLTAGE REGULATORS

CROSS-REFERENCE TO RELATED APPLICATIONS

This application claims priority to Italian Application Serial Number TO2003A000533, filed Jul. 10, 2003.

BACKGROUND OF THE INVENTION

1. Field of the Invention

The invention relates generally to voltage regulators and specifically to limiting the short circuit current in a voltage regulation circuit.

2. The Prior Art

FIG. 1 is a schematic illustrating a prior art voltage regulator circuit. Circuit 10 includes a power-controlling pass device, for example PMOS transistor 15, coupled between supply voltage 20 and output node 25. A stable output voltage Vout over a defined current IL range is produced between output node 25 and ground. The output of amplifier 30 is coupled to the gate of transistor 15, therefore regulating the behavior of transistor 15. Reference resistors 35 and 40 produce a voltage divider input for amplifier 30 and complete a regulation loop created by transistor 15, amplifier 30, and resistors 35 and 40. Capacitor 45 compensates the regulation loop.

Amplifier 30 compares the voltage across resistor 40 with reference voltage Vbg. Output voltage Vout is determined by the combination of reference voltage Vbg and resistors 35 and 40. As current IL increases above its maximum level, amplifier 30 starts to work in a non-liner mode (i.e. saturation) and as a consequence there is a decline the output voltage Vout. The voltage versus current behavior depends on the characteristics of transistor 15. One problem with circuit 10 is that if transistor 10 is large (for example, in order to have good power supply rejection ratio), then amplifier 30 saturates for high values of current IL in a regulator that features low current load range. This means that the regulator presents a very high short circuit current compared to the typical regulator load current. Such short circuit current primarily depends on characteristics of transistor 15 and is not directly controllable.

One solution for the above referenced problem features a switch connected between the gate of transistor 15 and the supply voltage 20, and controlled by the load current value IL. When the current IL is lower than a predetermined threshold the switch is open and the regulator works in normal operation. When IL is higher than the threshold, the switch is closed thus fixing the voltage at the controlling node of transistor 15, and so limiting the short circuit current of the regulator at the selected current threshold. The problem with this approach is that the rapid on-off state sequencing of the switch causes oscillation in circuit behavior.

What is needed is a current limitation circuit based on a simple architecture that provides a predictable output response and does not alter the behavior of the regulator in normal operation.

BRIEF DESCRIPTION OF THE INVENTION

A circuit for limiting a power current from a power-controlling pass device, the power-controlling pass device being coupled to a supply voltage, comprises the following. A sense device is coupled to the supply voltage with the sense device being configured to draw a sense current that is proportional to the power current. A current mirror is coupled to the sense device and the supply voltage through a low impedance node, for example a resistor, the current mirror being configured to draw a mirror current through the low impedance node that is relative to the sense current. In one embodiment the mirror current is approximately equal to the sense current, and therefore has approximately the same proportion to the power current. A limiting device is coupled to the supply voltage, the power-controlling pass device, and the low impedance node, the limiting device being configured to limit the power current according to a voltage difference between the low impedance node and the supply voltage. In one embodiment the limiting device, the power-controlling pass device and the sense device are all MOS transistors.

BRIEF DESCRIPTION OF THE DRAWING FIGURES

DETAILED DESCRIPTION OF THE INVENTION

The following description the invention is not intended to limit the scope of the invention to these embodiments, but rather to enable any person skilled in the art to make and use the invention.

Figure 1:
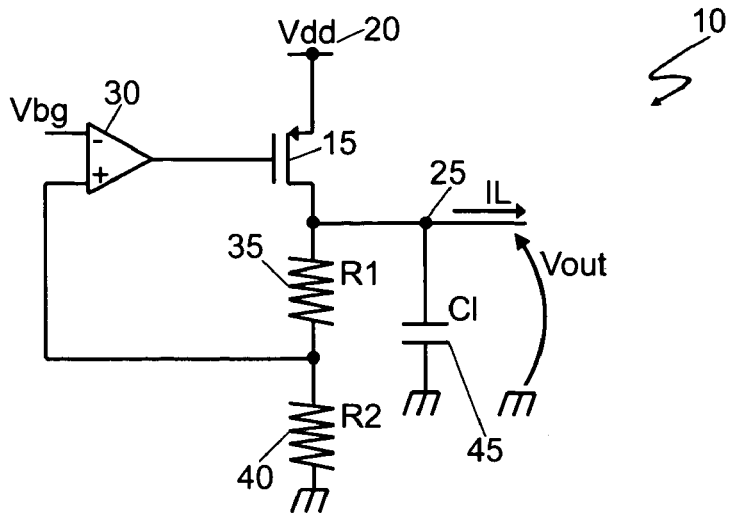
FIG. 1 PRIOR ART
FIG. 1 is schematic diagram illustrating a prior art voltage regulator circuit.
Figure 2:
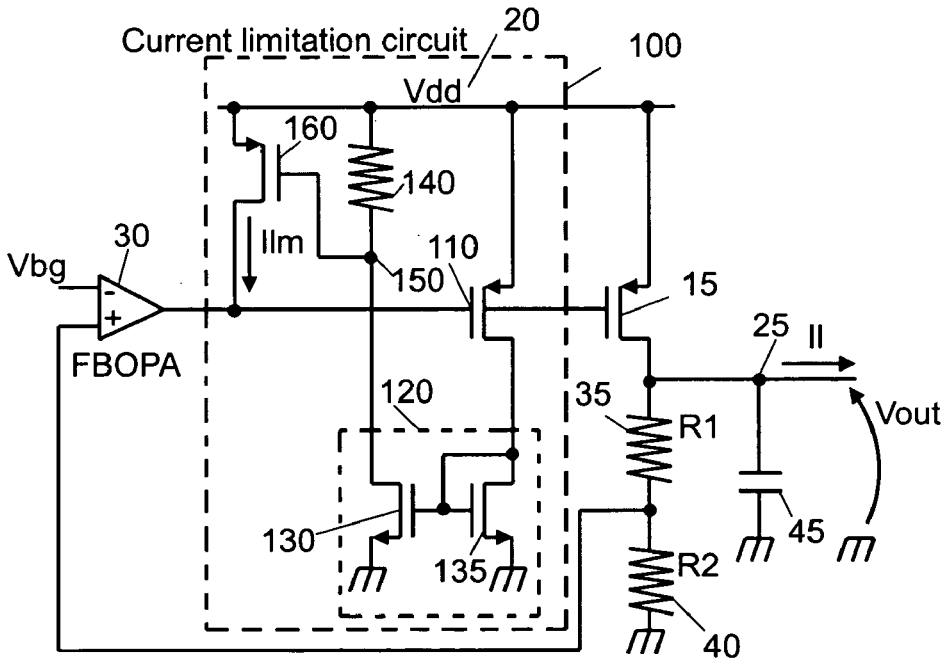
FIG. 2 is schematic diagram illustrating one embodiment of a current limitation circuit implemented with the voltage regulator circuit of FIG. 1.

FIG. 2 is schematic illustrating one embodiment of a current limitation circuit implemented with the voltage regulator circuit of FIG. 1. Current limitation circuit 100 includes a sense device, for example transistor 110, coupled to supply voltage Vdd, transistor 15, and amplifier 30. In this embodiment transistor 110 is smaller than transistor 15 by a know amount, the sources of both transistors are coupled to supply voltage 20, and both transistors share the same gate voltage from amplifier 30. Transistor 110 couples to current mirror 120, for example transistors 130 and 135 in a current mirror configuration. Current mirror 120 couples to resistor 140 through node 150. Resistor 140 couples to supply voltage 20 and a limiting device, for example transistor 160. Transistor 160 couples to amplifier 30. Node 150 is a low impedance node based on the voltage drop from supply voltage 20 across resistor 140. In another embodiment, transistor 160 is coupled to a low impedance node other than a resistor, for example a PMOS transistor properly biased in the triode region.

The sense device should provide a current based on the current of the device it is sensing. In this embodiment, sense device, or transistor 110, is smaller than transistor 15 by a known ratio and therefore provides a current through itself with the known ratio to the current through transistor 15. Current through transistor 110 necessarily passes through current mirror 120 and transistor 135 to ground. Current through node 150 and into current mirror 120 reflects, or approximates, current through transistor 110. Current mirrors may provide whatever ratio of current is desired, but in this embodiment a one-to-one ratio is used. Current through node 150 approximates the current through transistor 15 by the ratio of transistor 110 to transistor 15. If K is the ratio of transistor 110 to transistor 15 and current through transistor 15 is Il (neglecting current through resistors 35 and 40), then current through node 150 is K·Il.

In one embodiment, resistor 140 couples to supply voltage 20 and converts K·Il into a voltage across the source and gate of transistor 160. Limiting device, or transistor 160, clamps the voltage at the gates of transistors 110 and 15. Transistor 160 is driven through its gate by the voltage across resistor 140 with a resistance of Rlm, for a gate voltage of Rlm·K·Il. In one embodiment transistor 160 is a PMOS transistor.

Transistor 160 is driven by a low impedance node and may operate in saturation, so the transition between normal operation and an overcurrent mode is continuous and no stability problems appear since no on-off state sequence of transistor 160 occurs.

Figure 3:
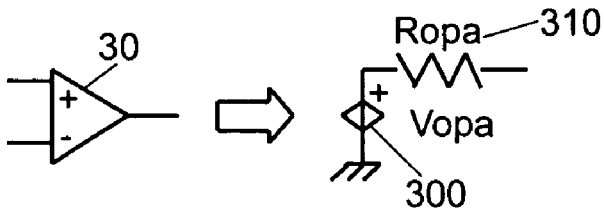
FIG. 3 is a schematic diagram illustrating a circuit equivalent for an amplifier.

FIG. 3 is a schematic illustrating a circuit equivalent for amplifier 30 from FIG. 2. In one embodiment amplifier 30 is an operational amplifier. A macromodel circuit of amplifier 30 represents the behavior of amplifier 30. The macromodel circuit is composed of ideal voltage controlled voltage source 300 with a voltage of Vopa and resistor 310 with a resistance of Ropa. In this macromodel $$Vopa = \begin{cases} Vdd - Vs & \text{when } Av\cdot(V_+ - V_-) > Vdd - Vs \\ Av\cdot(V_+ - V_-) & Vs < Av\cdot(V_+ - V_-) < Vdd - Vs \\ Vs & \text{when } Av\cdot(V_+ - V_-) < Vs, \end{cases}$$

where Vs is the saturation voltage of amplifier 30, Av is the DC differential voltage gain of amplifier 30, Vdd is supply voltage 20, $V_+$ is the noninverting input to amplifier 30, and $V_-$ is the inverting input to amplifier 30.

Vg is the gate voltage of transistors 110 and 15. Vg is determined by amplifier 30 and transistor 160:

$$Vg = Vopa + Ropa\cdot Ilm.$$

Ilm is the drain current of transistor 160 that is, when transistor 160 is on and in saturation:

$$Ilm = \frac{\beta lm}{2}, (K\cdot Rlm\cdot Il - |Vtop|)^2,$$

where Vtop is the threshold voltage and βlm is the gain factor of transistor 160. So $$Vg = Vopa + FIL,$$

where $$FIL \equiv \begin{cases} Ropa\cdot\frac{\beta lm}{2}\cdot(K\cdot Rlm\cdot Il - |Vtop|)^2 & \text{for } K\cdot Rlm\cdot Il > |Vtop| \\ 0 & \text{otherwise.} \end{cases}$$

Current limitation circuit 100 has three modes of operation: normal, overcurrent and short circuit. In normal operation, load current Il increases from zero and the regulation loop (transistor 15, resistors 35 and 40, and amplifier 30) makes Vout stable by adapting (i.e., by reducing) voltage Vopa. Once Il increases to where Rlm·K·Il>|Vtop| (the threshold voltage of transistor 160), transistor 160 turns on and begins injecting current Ilm into the output of amplifier 30 and so modifying voltage Vg (the gate voltage of transistors 110 and 15). While amplifier 30 is in the linear region, voltage Vopa is adapted to compensate the effect of Ilm and Vout remains stable. In normal operation transistor 15 is in the triode region and amplifier 30 is in the linear region, so:

$$Il = \beta reg\cdot\left[(Vg - Vdd) - \frac{Vout - Vdd}{2} - Vtop\right]\cdot(Vout - Vdd),$$

where $$Vg = Av\cdot\left(\frac{Vout\cdot R2}{R12} - Vbg\right) + FIL,\ R12 = R1 + R2,$$

βreg is the gain factor of transistor 15, R1 is the resistance of resistor 35 and R2 is the resistance of resistor 40. Substituting, the equation for Vg into the equation for Il, $$\left(Av\cdot\frac{R2}{R12} - \frac{1}{2}\right)\cdot Vout^2 + \left(-Av\cdot Vbg + FIL - Av\cdot\frac{R2}{R12}\cdot Vdd - Vtop\right)\cdot Vout + \left(Av\cdot Vbg\cdot Vdd - FIL\cdot Vdd + \frac{Vdd^2}{2} + Vtop\cdot Vdd - \frac{Il}{\beta reg}\right) = 0.$$

So, solving the quadratic equation for Vout:

$$Vout = \frac{-B - \sqrt{B^2 - 4\cdot A\cdot C}}{2\cdot A}$$

$$A = \left(Av\cdot\frac{R2}{R12} - \frac{1}{2}\right)$$

$$B = \left(-Av\cdot Vbg\cdot FIL - Av\cdot\frac{R2}{R12}\cdot Vdd - Vtop\right)$$

$$C = \left(Av\cdot Vbg\cdot Vdd - FIL\cdot Vdd + \frac{Vdd^2}{2} + Vtop\cdot Vdd - \frac{Il}{\beta reg}\right)$$

This is valid while amplifier 30 is in the linear region, i.e., $$Vopa > Vs$$

then $$Av\cdot\left(\frac{Vout\cdot R2}{R12} - Vbg\right) > Vs$$

then

-continued $$Vout > \frac{R12}{R2} \cdot \left(\frac{Vs}{Av} + Vbg\right).$$

As Il increases, Vopa decreases until it reaches Vs and amplifier 30 leaves the linear region and current limitation circuit 100 goes into overcurrent operation. The transition from normal to overcurrent operation is continuous and stable because a low impedance node (resistor 140) drives transistor 160 and transistor 160 is in saturation when reaching the saturation voltage of amplifier 30. The regulation loop does not work and voltage Vg becomes $$Vg = Vs + FIL.$$

As Il increases, the drain-to-source voltage of transistor 15 increases, and Vout starts to decrease. Due to current limitation circuit 100, Vg (gate voltage for transistors 110 and 15) is limited not to Vs (saturation voltage of amplifier 30), which occurs when no current limitation is present, but to a higher value, so the output voltage Vout begins decreasing at a lower level of load current Il.

During overcurrent operation, the current in transistor 15 is $$Il = \beta reg \cdot \left[(Vg - Vdd) - \frac{Vout - Vdd}{2} - Vtop\right] \cdot (Vout - Vdd).$$

Substituting, for Vg yields $$-\frac{1}{2} \cdot Vout^2 + (Vs + FIL - Vtop) \cdot Vout + \left(-Vs \cdot Vdd - FIL \cdot Vdd + \frac{Vdd^2}{2} + Vtop \cdot Vdd - \frac{Il}{\beta reg}\right) = 0.$$

Solving for Vout:

$$Vout = \frac{-B - \sqrt{B^2 - 4 \cdot A \cdot C}}{2 \cdot A}$$

$$A = -\frac{1}{2}$$

$$B = (Vs + FIL - Vtop)$$

$$C = \left(-Vs \cdot Vdd - FIL \cdot Vdd + \frac{Vdd^2}{2} + Vtop \cdot Vdd - \frac{Il}{\beta reg}\right).$$

This is valid while transistor 15 is in the triode region, $$Vs + FIL + |Vtop| < Vout < \frac{R12}{R2} \cdot \left(\frac{Vs}{Av} + Vbg\right).$$

As Il increases, Vout decreases and transistor 15 exits the triode region and enters saturation. Current limitation circuit 100 now enters short circuit operation. Load current Il is, while neglecting the channel modulation in transistor 15, $$Il = \frac{\beta reg}{2} \bullet (Vdd - Vg - Vtop)^2 \text{ where } Vg = Vs + FIL.$$

Substituting for Vg yields:

$$Il = \frac{\beta reg}{2} \cdot (Vdd - Vs - FIL - Vtop)^2,$$

and Vout goes to zero.

This value for load current Il represents the short circuit current, i.e., the current flowing in transistor 15 when Vout is zero (note that FIL is a function of Il, so the equation must be solved numerically). The short circuit current can be programmed by choosing the value of K, Rlm, and the size of transistor 160.

Without current limitation circuit 100, the short circuit current is $$Il = \frac{\beta reg}{2} \bullet (Vdd - Vs - Vtop)^2$$

which is higher than the short circuit current with current limitation circuit 100.

Figure 4:
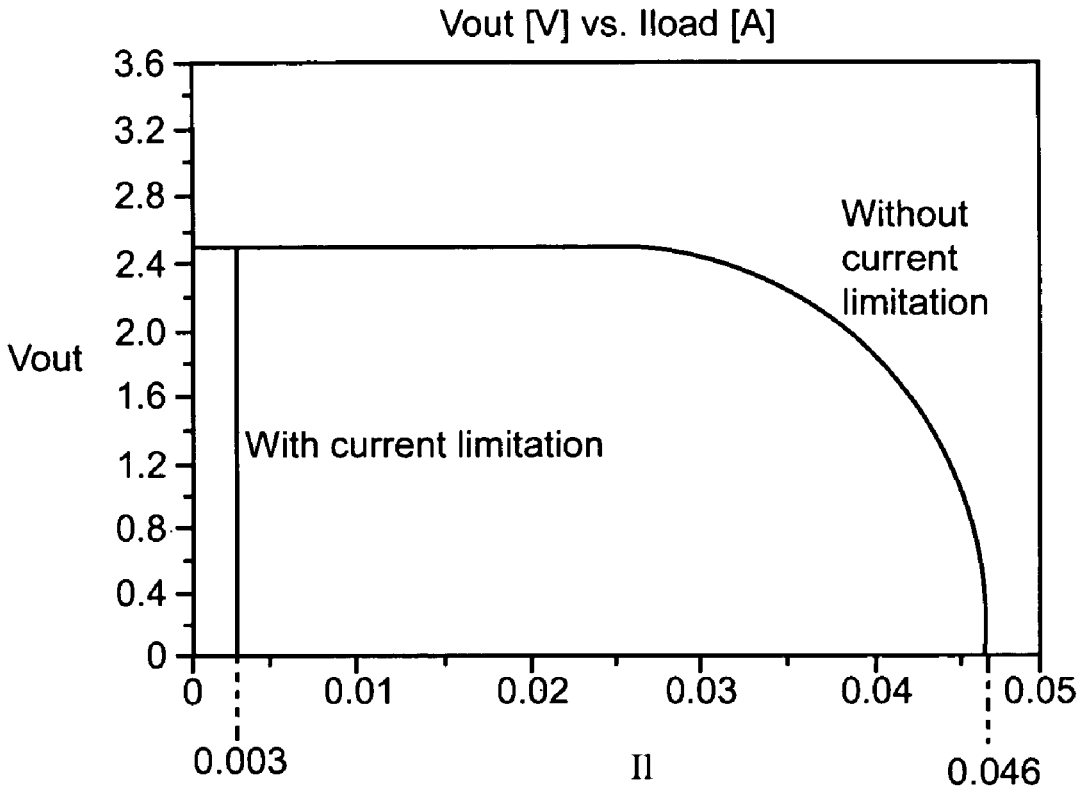
FIG. 4 is a graph illustrating output voltage versus load current for a voltage regulator with and without current limitation.

FIG. 4 is a graph illustrating output voltage Vout versus load current Il for a voltage regulator with and without current limitation. With current limitation, the short circuit current is approximately 3 mA. Without current limitation, the short circuit current is approximately 46 mA.

Figure 5:
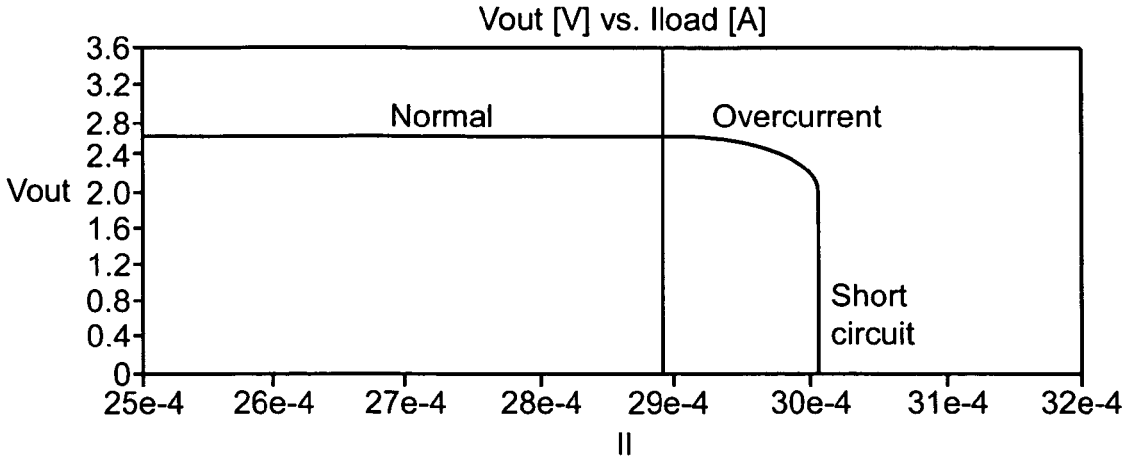
FIG. 5 is a graph illustrating output voltage versus load current for a voltage regulator with current limitation.

FIG. 5 is a graph illustrating output voltage versus load current for a voltage regulator with current limitation, from normal to overcurrent to short circuit operation. Normal operation, where the regulation loop regulates Vout by reducing Vopa as Il increases, is relatively stable at approximately 2.5 V while current increases to approximately 2.9 mA. Overcurrent mode, where amplifier 30 is saturated and Vg is limited, shows current increasing from approximately 2.9 mA to approximately 3.0 mA while Vout decreases from approximately 2.5 V to approximately 2.0 V. Short circuit mode, where transistor 15 is in saturation, shows current reaching a maximum value of approximately 3 mA while Vout drops to approximately 0 V.

Figure 6:
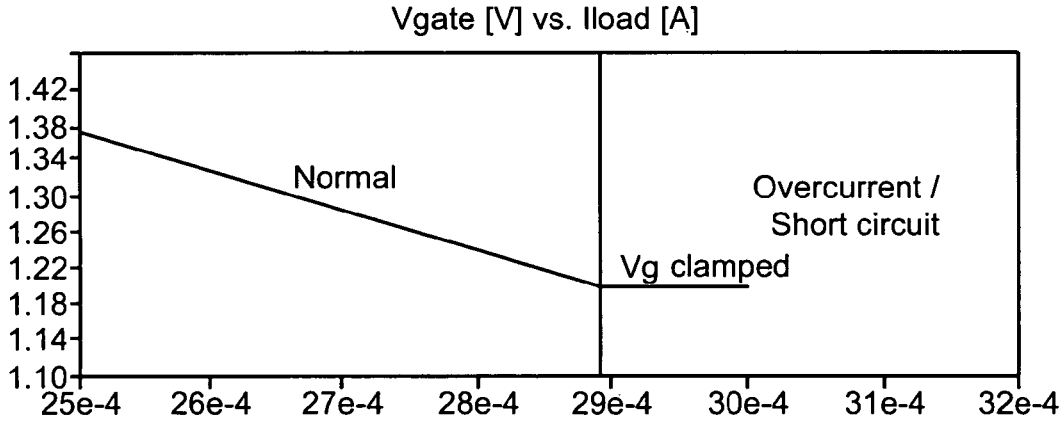
FIG. 6 is a graph illustrating control voltage versus load current for a voltage regulator with current limitation.

FIG. 6 is a graph illustrating gate voltage Vg for transistors 15 and 110 versus load current Il for a voltage regulator with current limitation. During normal operation, gate voltage Vg drops from approximately 1.38 V to approximately 1.19 V while current increases from approximately 2.5 mA to approximately 2.9 mA. At 2.9 mA of current Il, current limitation circuit 100 functions to clamp the Vg at approximately 1.19 volts as current Il increases to 3 mA.

Figure 7:
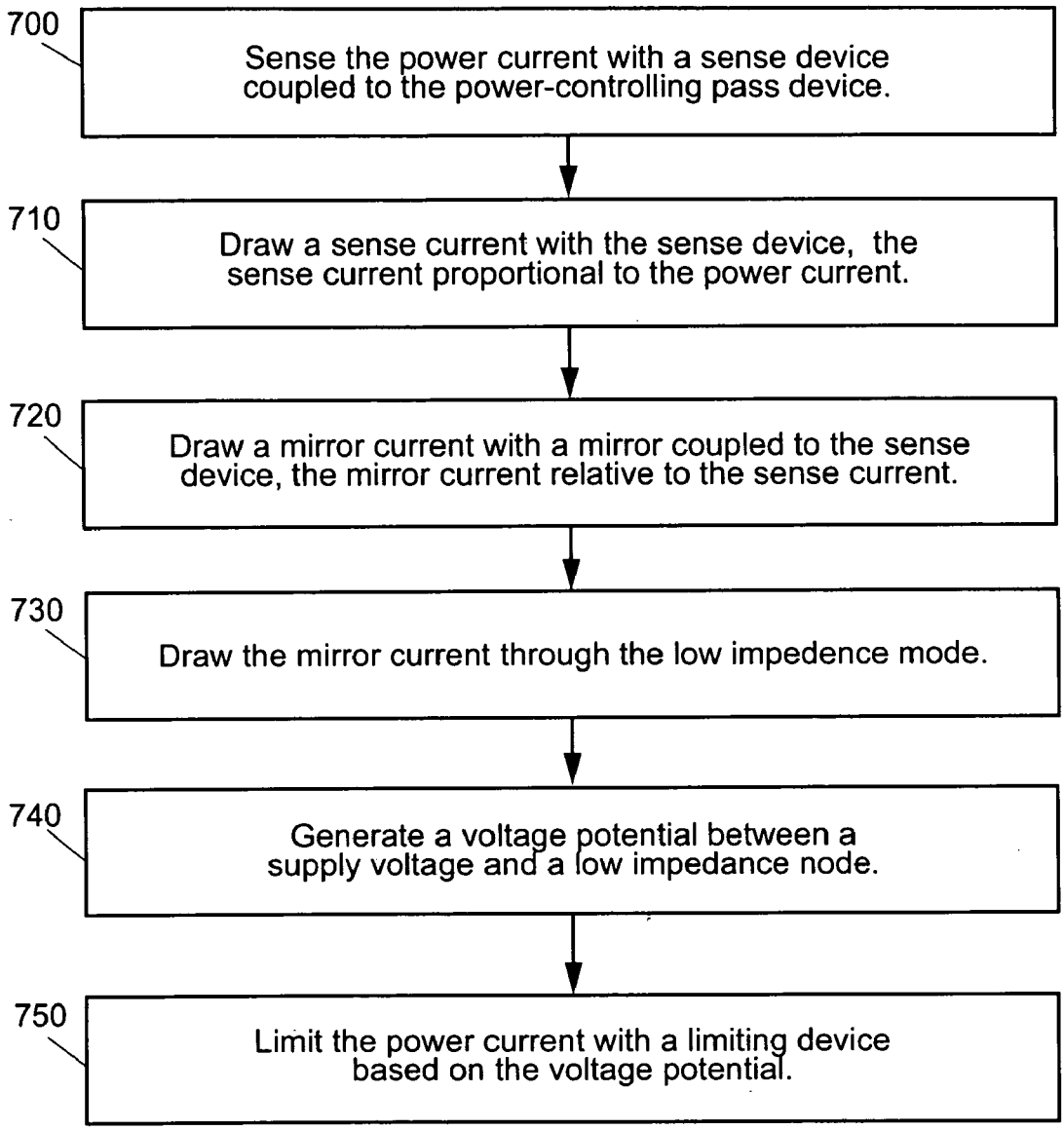
FIG. 7 is a block diagram illustrating a method for limiting power current from a power-controlling pass device.

FIG. 7 is a block diagram illustrating a method for limiting power current from a power-controlling pass device. In block 700, sense the power current with a sense device coupled to the power-controlling pass device. In block 710, draw a sense current with the sense device, the sense current proportional to the power current. In block 720, draw a mirror current with a current mirror coupled to the sense device, the mirror current relative to the sense current. In block 730, draw the mirror current through the low impedance node. In block 740, generate a voltage potential between a supply voltage and a low impedance node. In block 750, limit the power current with a limiting device based on the voltage potential.

The preceding equations apply to one exemplary embodiment and are not meant to limit the invention. The equations are presented in order to assist in understanding one embodiment of the invention. Any person skilled in the art will recognize from the previous description and from the figures and claims that modifications and changes can be made to the invention without departing from the scope of the invention defined in the following claims.

The invention claimed is:

1. A circuit for limiting a power current from a power-controlling pass device, the power-controlling pass device coupled to a supply voltage, comprising:

a sense device coupled to the supply voltage, the sense device configured to draw a sense current that is proportional to the power current;

a current mirror coupled to the sense device and coupled to the supply voltage, the current mirror configured to draw a mirror current that is relative to the sense current;

a resistor coupled to the supply voltage and to the current mirror, the resistor configured to carry the mirror current and generate a resistor voltage potential; and a limiting device coupled to the supply voltage, the power-controlling pass device, and to the resistor, the limiting device configured to limit the power current according to the resistor voltage potential.

2. The circuit of claim 1, wherein the sense device is smaller than the power-controlling pass device.

3. The circuit of claim 2, wherein the proportion of the sense current to the power current is the same as the proportion of the size of the sense device to the size of the power-controlling pass device.

4. The circuit of claim 3, wherein the limiting device, the sense device and the power-controlling pass device are MOS transistors.

5. The circuit of claim 1, wherein the sense device is further coupled to the power-controlling pass device and to the limiting device, the limiting device configured to limit the sense current according to the resistor voltage potential.

6. The circuit of claim 1, wherein the mirror current is approximately the same as the sense current.

7. The circuit of claim 1, further comprising an amplifier coupled to the sense device, the power-controlling pass device, and the limiting device, the amplifier having a saturation voltage.

8. The circuit of claim 7, further configured to function in three states, normal operation, overcurrent operation, and short circuit operation, normal operation occurring while the amplifier operates below its saturation voltage.

9. The circuit of claim 8, wherein the sense device, the power-controlling pass device, and the limiting device are MOS transistors, wherein the amplifier is coupled to the gate of the power-controlling pass device.

10. The circuit of claim 9, further configured to respond to overcurrent operation, which occurs when the amplifier reaches its saturation voltage and the power current increases, by clamping voltage at the gate of the power-controlling pass device using the limiting device.

11. The circuit of claim 10, further configured to respond to overcurrent operation with the limiting device in saturation.

12. The circuit of claim 9, further configured to respond to short circuit operation, which occurs when the power-controlling pass device operates in saturation, by having the power-controlling pass device drop the power current to approximately zero.

13. A circuit for limiting a power current from a power-controlling pass device coupled to a supply voltage, the circuit comprising:

a sense device coupled to the supply voltage, the sense device configured to draw a sense current that is proportional to the power current;

a current mirror coupled to the sense device and coupled to the supply voltage through a low impedance node, the current mirror configured to draw a mirror current through the low impedance node that is relative to the sense current; and a limiting device coupled to the supply voltage, the power-controlling pass device, and the low impedance node, the limiting device configured to limit the power current according to a voltage difference between the low impedance node and the supply voltage.

14. The circuit of claim 13, wherein the sense device is smaller than the power-controlling pass device.

15. The circuit of claim 14, wherein the proportion of the sense current to the power current is the same as the proportion of the size of the sense device to the size of the power-controlling pass device.

16. The circuit of claim 15, wherein the limiting device, the sense device and the power-controlling pass device are MOS transistors.

17. The circuit of claim 13, wherein the sense device is further coupled to the power-controlling pass device and to the limiting device, the limiting device configured to limit the sense current according to the voltage difference between the low impedance node and the supply voltage.

18. The circuit of claim 13, wherein the mirror current is approximately the same as the sense current.

19. The circuit of claim 13, further comprising an amplifier coupled to the sense device, the power-controlling pass device, and the limiting device, the amplifier having a saturation voltage and configured to limit the power current.

20. The circuit of claim 19, further configured to function in three states, normal operation, overcurrent operation, and short circuit operation, normal operation occurring while the amplifier operates below its saturation voltage.

21. The circuit of claim 20, wherein the sense device, the power-controlling pass device, and the limiting device are MOS transistors, wherein the amplifier is coupled to the gate of the power-controlling pass device.

22. The circuit of claim 21, further configured to respond to overcurrent operation, which occurs when the amplifier reaches its saturation voltage and the power current increases, by clamping voltage at the gate of the power-controlling pass device using the limiting device.

23. The circuit of claim 22, further configured to respond to overcurrent operation by operating the limiting device in saturation.

24. The circuit of claim 21, further configured to respond to short circuit operation, which occurs when the power-controlling pass device operates in saturation.

25. A method for limiting a power current from a power-controlling pass device coupled to a supply voltage, the method comprising:

generating a voltage potential between the supply voltage and a low impedance node; and limiting the power current with a limiting device based on the voltage potential.

26. The method of claim 25, further comprising:

sensing the power current with a sense device coupled to the power-controlling pass device.

27. The method of claim 26, further comprising:

drawing a sense current with the sense device, the sense current proportional to the power current.

28. The method of claim 27, wherein the sense device is smaller than the power-controlling pass device and the sense current has the same proportion to the power current as the sense device has to the power-controlling pass device.

29. The method of claim 27, further comprising:

drawing a mirror current with a current minor coupled to the sense device, the mirror current relative to the sense current.

30. The method of claim 29, wherein the mirror current is approximately equal to the sense current.

31. The method of claim 29, further comprising:

drawing the mirror current through the low impedance node.

* * * * *